United States Patent [19]

Golden

[11] 4,090,232

[45] May 16, 1978

[54] ILLUMINATION MEANS FOR THE HEAD

[76] Inventor: Douglas Golden, Rte. 2 Box 217, Bono, Ark. 72416

[21] Appl. No.: 827,317

[22] Filed: Aug. 24, 1977

[51] Int. Cl.[2] ..... F21L 15/14

[52] U.S. Cl. ..... 362/106; 362/105

[58] Field of Search ..... 240/6.4 W; 362/106, 362/105

[56] References Cited

U.S. PATENT DOCUMENTS 3,947,676 3/1976 Battilana et al. ..... 240/6.4 W

*Primary Examiner*—Stephen J. Lechert, Jr.

*Attorney, Agent, or Firm*—John R. Walker, III

[57] ABSTRACT

A light for being permanently attached to a hat and for directing a beam of light in the direction the person wearing the hat is looking. The light is adapted to allow the user thereof to vary the brightness of the beam of light produced thereby. Further, the light is adapted to be powered either by one or more electric storage batteries mounted on the hat or by an auxiliary source of electric power such as a standard electric trolling motor battery or the like. The auxiliary source of electric power is capable of, in addition to activating the light, recharging the electric storage batteries. The electric storage batteries are positioned about the hat so as to substantially evenly distribute the weight of the light over the head of the person wearing the hat.

9 Claims, 7 Drawing Figures

ILLUMINATION MEANS FOR THE HEAD

BACKGROUND OF THE INVENTION

1. Field of the Invention

This invention relates, in general, to illumination means and, more specifically, to illumination means for being worn about a person's head to direct a beam of light in the direction the person is looking.

2. Description of the Prior Art

The following U.S. patents relate to the present invention: Matz, U.S. Pat. No. 1,215,043; Waechter, U.S. Pat. No. 2,234,995; Rowland, U.S. Pat. No. 2,739,225; Scott, U.S. Pat. No. 3,086,516; Kivela, U.S. Pat. No. 3,601,595; and Eriksson, U.S. Pat. No. 3,912,919. None of the above patents disclose or suggest the present invention.

Heretofore, all known illumination means for being worn about a person's head have been disadvantageous for one reason or another. For example, all known self-contained headlights and spotlights must be partially disassembled to change, replace or recharge the batteries and light bulbs thereof. Also, all known headlights are uncomfortable to wear for extended periods since the weight thereof is concentrated over one area of the wearer's head. Scott, U.S. Pat. No. 3,086,516, utilizes a counterweight to offset the weight of the headlight. This approach, while offsetting the weight of the light unit and therefore making the unit more comfortable to wear, also results in substantially doubling the weight of the unit which, in itself, prevents optimum comfort to the wearer of the headlight.

SUMMARY OF THE INVENTION

The present invention is directed towards overcoming the above and other disadvantages of prior self-contained headlights and the like. The concept of the present invention is to provide an illumination means for being worn about a person's head to direct a beam of light in the direction the person is looking and which includes a source of electric power, an electric light bulb, a circuit means for electrically coupling the source of electric power and the light bulb, the circuit means including an adjustment means for varying the amount of electric power passing from the source of electric power to the light bulb to thereby vary the brightness of the light bulb, and an attachment means for attaching the source of electric power and the light bulb to a person's head.

DESCRIPTION OF THE PREFERRED EMBODIMENT

Figure 1:
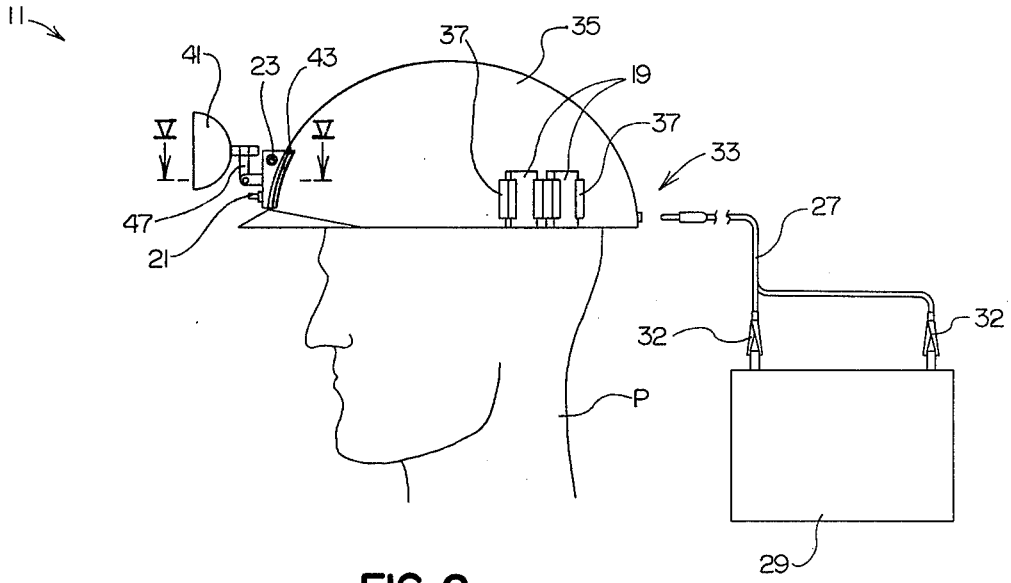
FIG. 1 is a side elevational view of the illumination means of the present invention shown being worn by a person.
Figure 2:
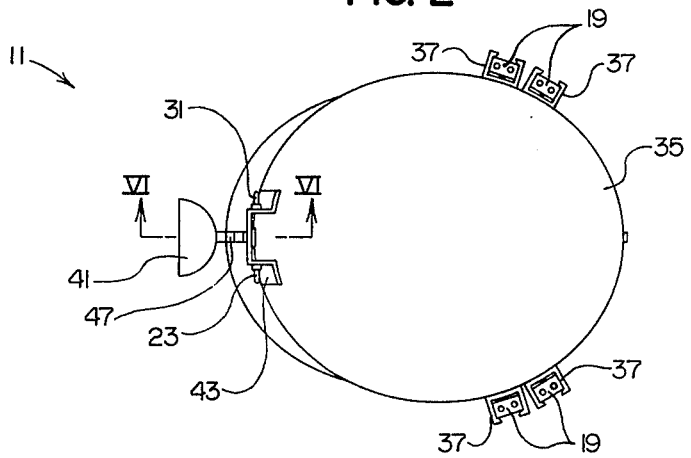
FIG. 2 is a top plan view of a portion thereof.
Figure 3:
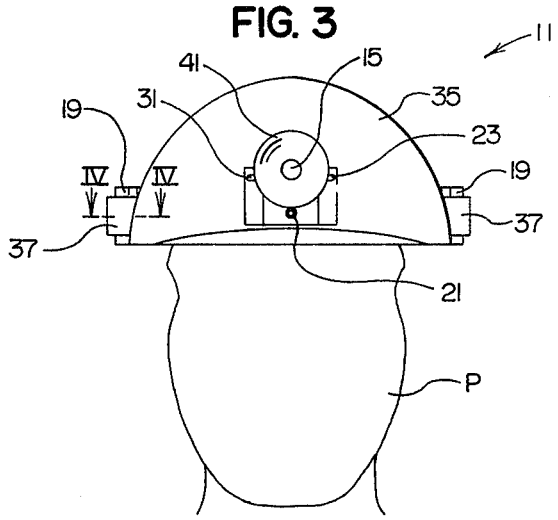
FIG. 3 is a front elevational view of FIG. 1.
Figure 6:
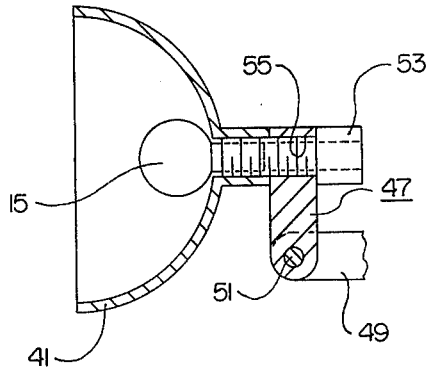
FIG. 6 is a sectional view of a portion thereof as taken on line VI—VI of FIG. 2.

The illumination means 11 of the present invention is for being worn about the head of a person P so as to direct a beam of light in the direction the person P is looking. The illumination means includes, in general, a source 13 of electric power (see FIG. 7); an electric light bulb 15 (see FIG. 3, 6 and 7); a circuit means 17 for electrically coupling the source 13 of electric power and the electric light bulb 15 so as to allow the source 13 of electric power to activate the electric light bulb 15 in a well known manner (see FIG. 7); and an attachment means for attaching the source 13 of electric power and the light bulb 15 to the head of a person (see, in general, FIGS. 1 and 3).

The source 13 of electric power preferably consists of one or more electric storage batteries 19, four being shown in the drawings. Preferably, the batteries 19 are nine-volt alkaline or mercury batteries which can be readily recharged for reasons which will hereinafter become apparent. The circuit means 17 is preferably provided with a battery connector (not shown) for electrically connecting each battery 19 in series as well as apparent to those skilled in the art to allow electric power to pass from the batteries 19 to the light bulb 15.

The electric light bulb 15 may be of any type apparent to those skilled in the art for being activated by the batteries 19. For example, the light bulb 15 may be a 5.95 volt light bulb for use with the four nine-volt batteries 19. It will be apparent to those skilled in the art that different light bulbs may be used for different sources of electric power.

The circuit means 17 includes an adjustment means such as a rheostat 21 or the like for varying the amount of electric power passing from the batteries 19 to the light bulb 15 so as to thereby vary the brightness of the light bulb 15 in a manner which will be apparent to those skilled in the art. The circuit means 17 preferably includes an on-off switch 23 for selectively allowing or preventing the passage of electric power from the batteries 19 to the light bulb 15 to thereby allow the person P to turn the illumination means 11 on or off as will be apparent to those skilled in the art.

Figure 7:
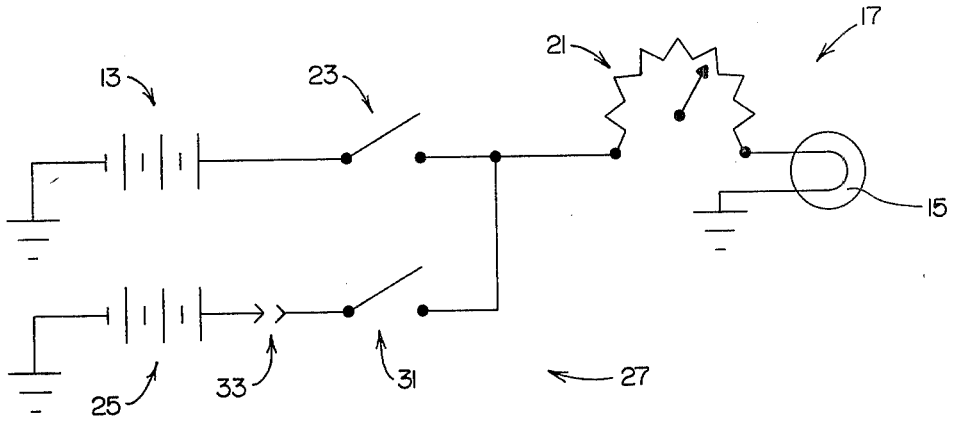
FIG. 7 is an electrical schematic view thereof.

The illumination means 11 preferably includes an auxiliary source 25 of electric power (see FIG. 7). The circuit means 17 preferably includes an auxiliary means 27 for electrically coupling the auxiliary source 25 of electric power to the light bulb 15. The auxiliary source 25 of electric power preferably consists of a battery 29 (see, in general, FIG. 1) which may be a 12-volt car battery, a 6 volt lantern battery, a standard electric trolling motor battery, as typically used by boaters such as fishermen, or the like. It should be noted that when a 12-volt battery is used, the light bulb 15 should be an 8.63-volt light bulb or the like as will be apparent to those skilled in the art. The auxiliary means 27 of the circuit means 17 preferably includes an on-off switch 31 for selectively allowing or preventing the passage of electric power from the battery 29 to the light bulb 15 to thereby allow the person P to turn the illumination means 11 on or off. Standard alligatortype clamps 32 (see FIG. 1) may be provided to removably attach the battery 29 and the auxiliary means 27. Additionally, the auxiliary means 27 preferably includes a plug-in type connector 33 for reasons which will hereinafter become apparent. The circuit means 17 is preferably adapted to allow electric power to pass from the battery 29 to the batteries 19 when both on-off switches 23, 31 are closed to allow the electric power from the battery 29 to recharge the batteries 19 in a manner which should now be apparent to those skilled in the art.

The attachment means preferably includes a hat member 35 for fitting over the head of the person P and for supporting the light bulb 15, batteries 19, and a portion of the circuit means 17. More specifically, the light bulb 15, batteries 19, rheostat 21, and on-off switches 23, 31 are preferably mounted on the hat member 35 as clearly shown in the drawings. The hat member 35 may be of any construction apparent to those skilled in the art. Preferably, the hat member 35 is constructed of a substantially hard substance. The light bulb 15, batteries 19, rheostat 21 and on-off switches 23, 31 are preferably arranged on the hat member 35 in such a manner so as to substantially evenly distribute the weight thereof over the head of the person P so as to make the illumination means 11 comfortable for the person P to wear.

Figure 4:
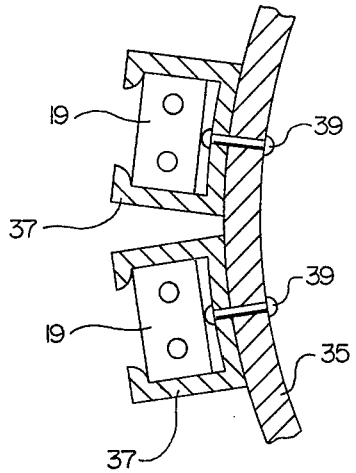
FIG. 4 is a sectional view of a portion thereof as taken on line IV—IV of FIG. 3.

The attachment means preferably includes one or more clip members 37 fixedly attached to the hat member 35 by rivets 39 or the like (see FIG. 4) for removably mounting the batteries 19 to the hat member 35, thereby allowing the batteries 19 to be removed and/or replaced without having to remove or disassemble any other part of the illumination means 11. The clip member 37 may be constructed of spring metal or the like.

The illumination means 11 preferably includes an opened reflector member 41 (see, in general, FIG. 6) associated with the light bulb 15 to cause the light bulb 15 to form a beam of light when activated and to allow the light bulb 15 to be removed and/or replaced without having to remove or disassemble any other part of the illumination means 11.

Figure 5:
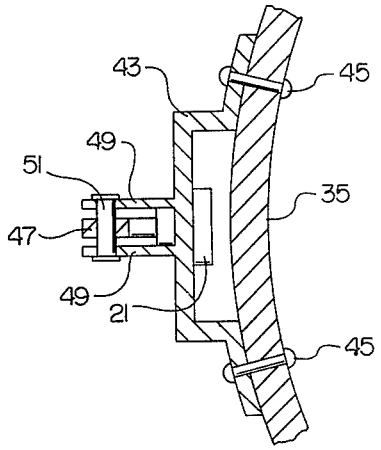
FIG. 5 is a sectional view of a portion thereof as taken on line V—V of FIG. 1.

The attachment means preferably includes means for mounting the light bulb 15 and reflector member 41 to the hat member 35 in such a manner that the beam of light created by the light bulb 15 can be vertically adjusted. This means preferably includes a bracket like member 43 for being fixedly attached to the hat member 35 by bolts 45 or the like (see, in general, FIG. 5). The bracket like member 43 is preferably adapted to support the rheostat 21 and the on-off switches 23, 31 in a position which allows the person P to operate the same and as clearly shown in the drawings. Additionally, an arm-like member 47 is pivotally mounted to one or more projections 49 of the bracket-like member 43 by a rivet 51 or the like (see, in general, FIGS. 5 and 6).

The light bulb 15 and reflector member 41 is, in turn, attached to the distal end of the arm-like member 47 so that the beam of light created by the light bulb 15 and reflector 41 can be vertically adjusted by merely pivoting the arm-like member 47 about the rivet 51 as should be apparent to those skilled in the art from the drawings. The light bulb 15 and reflector member 41 may be attached to the arm-like member 47 in any manner apparent to those skilled in the art. For example, a light bulb holder 53 may be provided for fixedly holding the light bulb 15 and for being screwably attached to the reflector member 41 as clearly shown in FIG. 6. The arm-like member 47 may be provided with an aperture 55 for allowing a portion of the light bulb holder 53 to extend therethrough so as to fixedly attach the reflector member 41 to the arm-like member 47 as clearly shown by FIG. 6.

The use of the illumination means 11 is quite simple. to activate the light bulb 15 by way of the batteries 19, the on-off switch 23 is merely closed, thereby allowing electric power to pass from the batteries 19 to the light bulb 15. The brightness and intensity of the beam of light thus created by the light bulb 15 can be varied by adjusting the rheostat 21 in a manner and for reasons which will be apparent to those skilled in the art. If it is desired to activate the light bulb 15 by way of the battery 29, the on-off switch 23 is left open and the on-off switch 31 is closed to allow electric power to pass from the battery 29, through the plug-in type connector 33 and to the light bulb 15. Here again, the brightness and intensity of the beam of light created by the light bulb 15 can be varied by adjusting the rheostat 21.

Although the invention has been described and illustrated with respect to a preferred embodiment thereof, it is not to be so limited since changes and modifications may be made therein which are within the full intended scope of the invention.

I claim:

1. Illumination means for being worn about a person's head to direct a beam of light in the direction the person is looking, said illumination means comprising:

(a) a source of electric power;

(b) an electric light bulb;

(c) circuit means for electrically coupling said source of electric power and said light bulb, said circuit means including adjustment means for varying the amount of electric power passing from said source of electric power to said light bulb to thereby vary the brightness of said light bulb; and (d) attachment means for attaching said source of electric power and said light bulb to a person's head; said source of electric power, said light bulb, and said circuit means being mounted on said attachment means and being arranged on said attachment means in such a manner so as to substantially evenly distribute the weight thereof over the person's head.

2. The illumination means of claim 1 in which said circuit means includes an on-off switch for selectively allowing or preventing the passage of electric power from said source of electric power to said light bulb.

3. The illumination means of claim 2 in which is included an auxiliary source of electric power and in which said circuit means includes means for electrically coupling said auxiliary source of electric power to said light bulb and an on-off switch for selectively allowing or preventing the passage of electric power from said auxiliary source of electric power to said ligh bulb.

4. The illumination means of claim 2 in which said attachment means includes a hat member for fitting over the person's head; said source of electric power, said light bulb, said adjustment means and said on-off switch being mounted on said attachment means.

5. The illumination means of claim 3 in which said source of electric power includes an electric storage battery and in which said circuit means is adapted to allow electric power to pass from said auxiliary source of electric power to said electric storage battery to thereby recharge said electric storage battery.

6. The combination with a hat of the type for being worn about a person's head, of an illumination means for directing a beam of light in the direction the person is looking, said illumination means comprising:

(a) a source of electric power removably attached to said hat;

(b) an electric light bulb removably attached to the front of said hat; and (c) circuit means for electrically coupling said source of electric power and said light bulb, said circuit means including an adjustment means for varying the amount of electric power passing from said source of electric power to said light bulb to thereby vary the brightness of said light bulb; said source of electric power, said electric light bulb, and said circuit means being mounted on said hat and being arranged on said hat in such a manner so as to substantially evenly distribute the weight thereof over the person's head.

7. The combination of claim 6 in which said source of electric power, said light bulb, said adjustment means, and said first and second on-off switches are attached on said hard hat in such a manner so as to substantially evenly distribute the weight thereof about the person's head.

8. The combination of claim 6 in which said source of electric power includes an electric storage battery and in which said circuit means is adapted to allow electric power to pass from said auxiliary source of electric power to said electric storage battery to thereby recharge said electric storage battery.

9. The combination of claim 8 in which said light bulb and said electric storage battery can be replaced without disassembling any part of said illumination means.

* * * * *